US010154548B2

(12) United States Patent
Nishijima et al.

(10) Patent No.: US 10,154,548 B2
(45) Date of Patent: Dec. 11, 2018

(54) HEATING COOKER

(71) Applicant: SHARP KABUSHIKI KAISHA, Osaka-shi, Osaka (JP)

(72) Inventors: Masahiro Nishijima, Osaka (JP); Shinji Asami, Osaka (JP); Masaki Katabe, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 292 days.

(21) Appl. No.: 15/023,598

(22) PCT Filed: Feb. 23, 2015

(86) PCT No.: PCT/JP2015/055020
§ 371 (c)(1),
(2) Date: Mar. 21, 2016

(87) PCT Pub. No.: WO2015/129619
PCT Pub. Date: Sep. 3, 2015

(65) Prior Publication Data

US 2016/0212801 A1 Jul. 21, 2016

Related U.S. Application Data

(63) Continuation-in-part of application No. 13/819,642, filed as application No. PCT/JP2011/069394 on Aug. 29, 2011, now Pat. No. 9,532,408.

(30) Foreign Application Priority Data

Aug. 31, 2010 (JP) ..... 2010-193612
Feb. 26, 2014 (JP) ..... 2014-035927
Feb. 27, 2014 (JP) ..... 2014-036988

(51) Int. Cl.
*H05B 6/64* (2006.01)

(52) U.S. Cl.
CPC ..... *H05B 6/642* (2013.01)

(58) Field of Classification Search
CPC ..... H05B 6/642
(Continued)

(56) References Cited

U.S. PATENT DOCUMENTS 3,973,551 A * 8/1976 Caselani ..... A21B 1/28 126/21 A
5,140,120 A * 8/1992 Kasai ..... H05B 6/6411 126/21 A
(Continued)

FOREIGN PATENT DOCUMENTS

JP 53-44744 10/1978
JP 59-8319 A 1/1984
(Continued)

*Primary Examiner* — Thien S Tran
(74) *Attorney, Agent, or Firm* — Birch, Stewart, Kolasch & Birch, LLP

(57) ABSTRACT

A heating cooker includes a body casing, a heating chamber, a magnetron that supplies microwaves into the heating chamber, a cooling fan that delivers cooling air flow to the magnetron, an air discharge duct that is for discharging discharge air from inside of the heating chamber to outside, a first guiding channel that guides into the heating chamber a portion of the cooling air flow from the cooling fan which has flowed out to a downstream side after cooling the magnetron, and a second guiding channel that guides toward the air discharge duct another portion of the cooling air flow from the cooling fan which has flowed out to the downstream side after cooling the magnetron.

10 Claims, 12 Drawing Sheets

(58) Field of Classification Search
USPC ..... 99/324, 352, 467; 126/20, 21 A, 21 R, 126/299 R; 219/681, 707, 748, 757
See application file for complete search history.

(56) References Cited

U.S. PATENT DOCUMENTS

| | | | | |
|---|---|---|---|---|
| 2010/0200577 | A1* | 8/2010 | Iwamoto ..... | H05B 6/6429 219/757 |
| 2013/0153571 | A1* | 6/2013 | Asami ..... | H05B 6/6402 219/757 |

FOREIGN PATENT DOCUMENTS

| | | | |
|---|---|---|---|
| JP | 1-38877 | Y2 | 11/1989 |
| JP | 2-54887 | A | 2/1990 |
| JP | 3-283288 | A | 12/1991 |
| JP | 5-90205 | U | 12/1993 |
| JP | 9-273759 | A | 10/1997 |
| JP | 2012-51694 | A | 3/2012 |

* cited by examiner

HEATING COOKER

This application claims priority to prior U.S. patent application Ser. No. 13/819,642 filed on Feb. 27, 2013 (now U.S. Pat. No. 9,532,408) which is a national phase filing of PCT application PCT/JP2011/069394 filed on Aug. 29, 2011 to which priority is also claimed.

TECHNICAL FIELD

The present invention relates to a heating cooker and particularly relates to a heating cooker that heats objects to be heated, by microwaves.

BACKGROUND ART

There has been a conventional heating cooker including a heating-chamber fan which supplies outside air into a heating chamber through an air intake duct, an air discharge duct which guides discharge air from inside of the heating chamber downward to an air discharge port, a cooling fan which is provided below a magnetron, and a space part through which cooling air flow from the cooling fan flows along the air discharge duct after cooling the magnetron (see JP H09-273759 A (PTL 1), for instance).

CITATION LIST

Patent Literature

PTL1: JP H09-273759 A

SUMMARY OF INVENTION

Technical Problem

The conventional heating cooker has a problem in that the cooling air flow having cooled the magnetron is not effectively used because the cooling air flow that has a temperature increased by having cooled the magnetron cools electric components on a downstream side and is thereafter discharged as it is through the space part to outside.

An object of the invention is to provide a heating cooker having a simple configuration in which cooling air flow having cooled a magnetron can effectively be used.

Solution to Problem

In order to achieve the object, a heating cooker of the invention comprising:

a body casing, a heating chamber that is placed in the body casing, a magnetron that is placed in the body casing and that supplies microwaves into the heating chamber, a cooling fan that is placed in the body casing and that delivers cooling air flow to the magnetron, an air discharge duct that is for discharging discharge air from inside of the heating chamber to outside, a first guiding channel that guides into the heating chamber a portion of the cooling air flow from the cooling fan which has flowed out to a downstream side after cooling the magnetron, and a second guiding channel that guides toward the air discharge duct another portion of the cooling air flow from the cooling fan which has flowed out to the downstream side after cooling the magnetron.

The heating cooker in accordance with an embodiment further includes a third guiding channel that guides a portion of the cooling air flow from the cooling fan so that the portion blows off toward a front face side in the body casing without passing through a cooling channel in the magnetron.

The heating cooker in accordance with an embodiment further includes air intake ports provided on the front face side of the body casing, wherein the cooling fan sucks outside air from the front face side through the air intake ports.

In the heating cooker in accordance with an embodiment, in an air discharge path for discharge from the air discharge duct to the outside, the cooling air flow guided by the third guiding channel is made to flow into the air discharge duct on an upstream side of a position where the cooling air flow from the second guiding channel flows into the air discharge duct.

In the heating cooker in accordance with an embodiment, the air discharge duct causes the discharge air discharged from the heating chamber and the cooling air flow guided by the second guiding channel to be mixed therein and to be discharged to the outside.

The heating cooker in accordance with an embodiment includes air intake ports provided on a front face side of the body casing, wherein an air discharge port on a downstream side in the air discharge duct is provided on the front face of the body casing so that the discharge air mixed in the air discharge duct blows off toward a side opposed to the air intake ports.

The heating cooker in accordance with an embodiment further includes an ejector part that is provided in the air discharge duct and that is for drawing the discharge air from the inside of the heating chamber into the air discharge duct by the cooling air flow flowing into the air discharge duct under guidance of the second guiding channel.

The heating cooker in accordance with an embodiment further includes a blower duct that guides the cooling air flow from the cooling fan into a cooling channel in the magnetron.

The heating cooker in accordance with an embodiment further includes air discharge fans provided on a rear face side of the air discharge duct, and inclined members provided at positions where the cooling air flow from the first guiding channel or the second guiding channel flows into the air discharge duct, wherein the inclined members extend to positions facing front face sides of the air discharge fans.

Advantageous Effects of Invention

According to the invention, as is evident from above, the heating cooker can be provided in which the portion of the cooling air flow from the cooling fan that has flowed out to the downstream side after cooling the magnetron is guided into the heating chamber by the first guiding channel, in which another portion of the cooling air flow from the cooling fan 21 that has flowed out to the downstream side after cooling the magnetron is guided toward the air discharge duct by the second guiding channel, and in which the cooling air flow having cooled the magnetron can effectively be used as a result.

DESCRIPTION OF EMBODIMENTS

Figure 1:
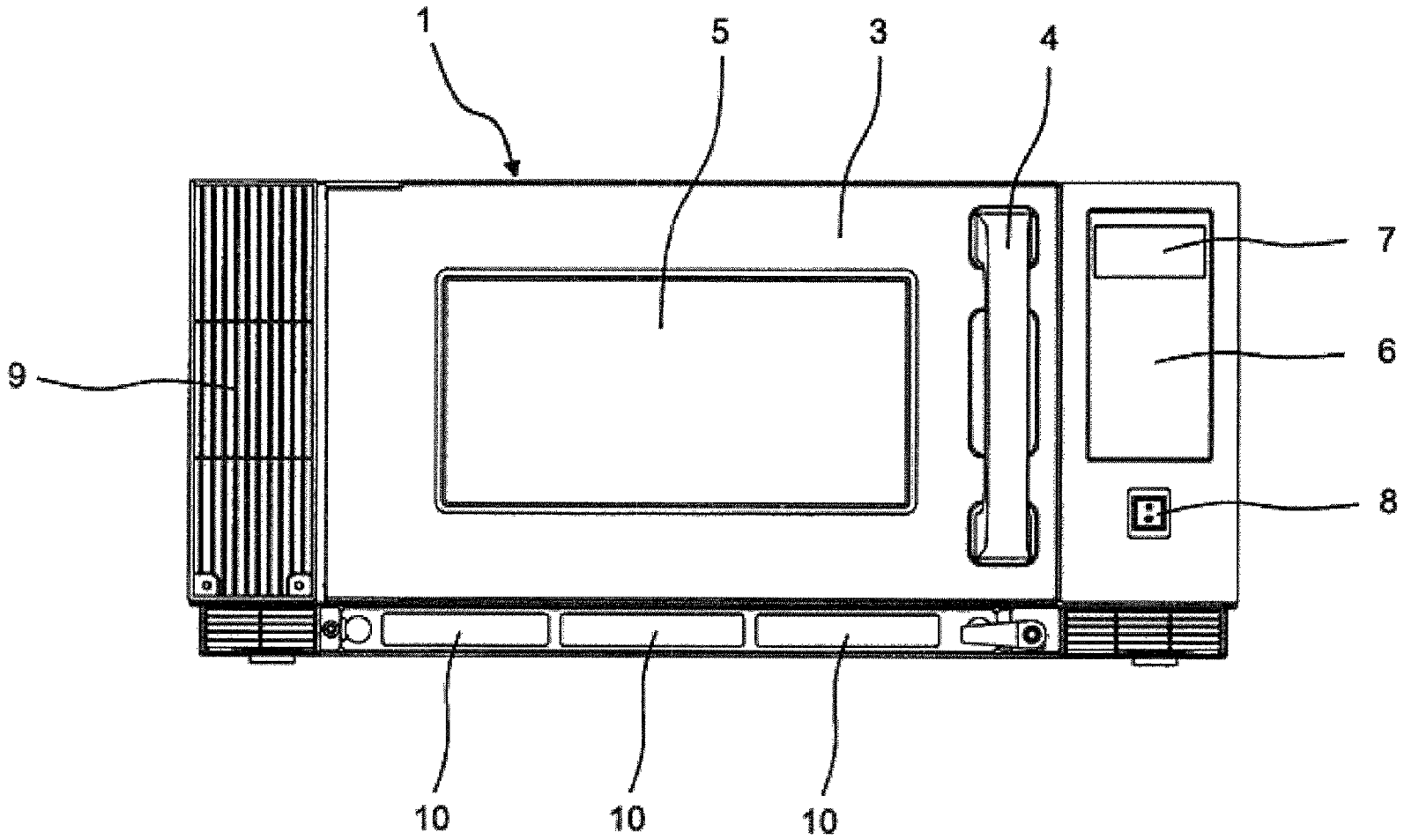
FIG. 1 is a front view of a heating cooker in accordance with a first embodiment of the invention.

Hereinbelow, heating cookers of the invention will be described in detail with reference to embodiments shown in the drawings.

First Embodiment

FIG. 1 shows a front view of a heating cooker in accordance with a first embodiment of the invention.

As shown in FIG. 1, the heating cooker in accordance with the first embodiment includes a body casing 1 shaped like a rectangular parallelepiped, a heating chamber 2 (shown in FIGS. 2 through 4) provided in the body casing 1, and a door 3 pivotably mounted on a front face side of the body casing 1.

The door 3 pivots on a left side so as to open and close an opening of the heating chamber 2. A handle 4 is mounted on a right part of the door 3. A heat resistant glass plate 5 is provided at a generally center part of the door 3, so that a state in the heating chamber 2 is visible to a user through the heat-resistant glass plate 5. Packing (not shown) made of heat resistant resin is fixed onto a rear face of the door 3 so as to surround the heat resistant glass plate 5. When the door 3 is closed, the packing is brought into strong and intimate contact with a peripheral part on the opening of the heating chamber 2 so as to provide sealing between the door 3 and the peripheral part on the opening of the heating chamber 2.

An operation panel 6 is provided on a right side on a front face of the body casing 1. The operation panel 6 has a liquid crystal display part 7 mounted on a display substrate 40 (shown in FIG. 2). A power switch 8 is provided under the operation panel 6.

An air discharge port 9 is provided on a left side on the front face of the body casing 1 and three air intake ports 10 are provided under the door 3 on the front face of the body casing 1.

Figure 2:
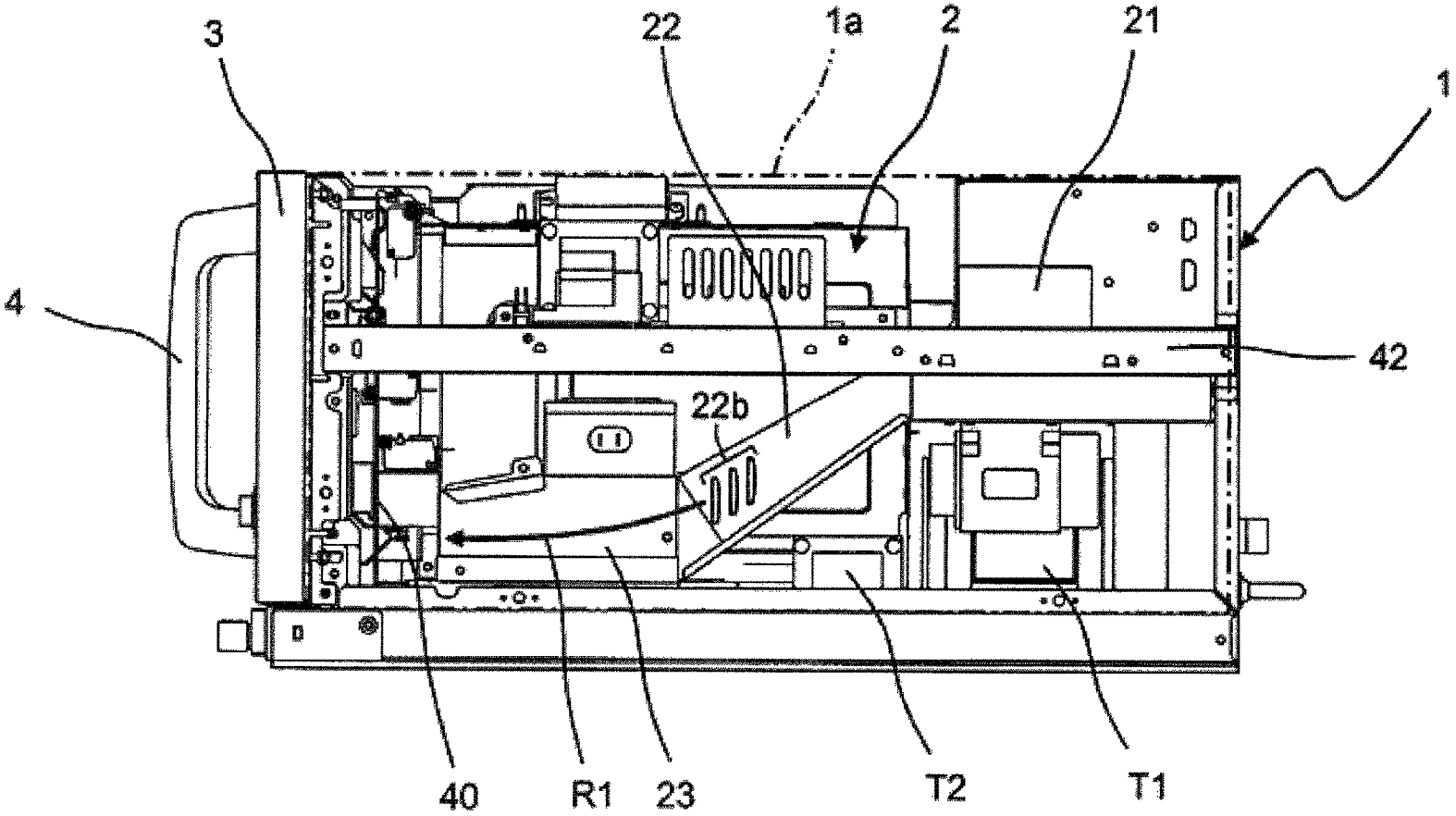
FIG. 2 is a right side view of the heating cooker in which an upper cover of a body casing has been removed.

FIG. 2 shows a right side view of the heating cooker in which an upper cover 1*a* of the body casing 1 has been removed and reference characters T1, T2 in FIG. 2 denote transformers placed on a bottom plate of the body casing 1.

As shown in FIG. 2, a cooling fan 21 is provided at a position on a right side of and at rear of the heating chamber 2 in the body casing 1. A sirocco fan is used as the cooling fan 21. The cooling fan 21 that has a suction port directed downward is placed over the transformer T1 that generates a large amount of heat. A blower duct 22 having one end connected to a blow-off side of the cooling fan 21 is connected at the other end to a magnetron 23. Rectangular sections of the blower duct 22 gradually broaden from a side of the cooling fan 21 toward the magnetron 23. The display substrate 40 is placed at a position that is on the front face side in the body casing 1 and that faces the magnetron 23.

Blow-off ports 22*b* for blow-off through a right side of the magnetron 23 toward the front face side are provided in a vicinity of the magnetron 23 on a right side surface of the blower duct 22. Cooling air flow having blown off from the blow-off ports 22*b* of the blower duct 22 is smoothly guided toward the front face side in the body casing 1 (along an arrow R1), without passing through the magnetron 23, by a space surrounded by a portion of the blower duct 22, a right side surface of a housing of the magnetron 23, and the body casing 1. A third guiding channel is formed of the space surrounded by the portion of the blower duct 22, the right side surface of the housing of the magnetron 23, and the body casing 1.

Figure 3:
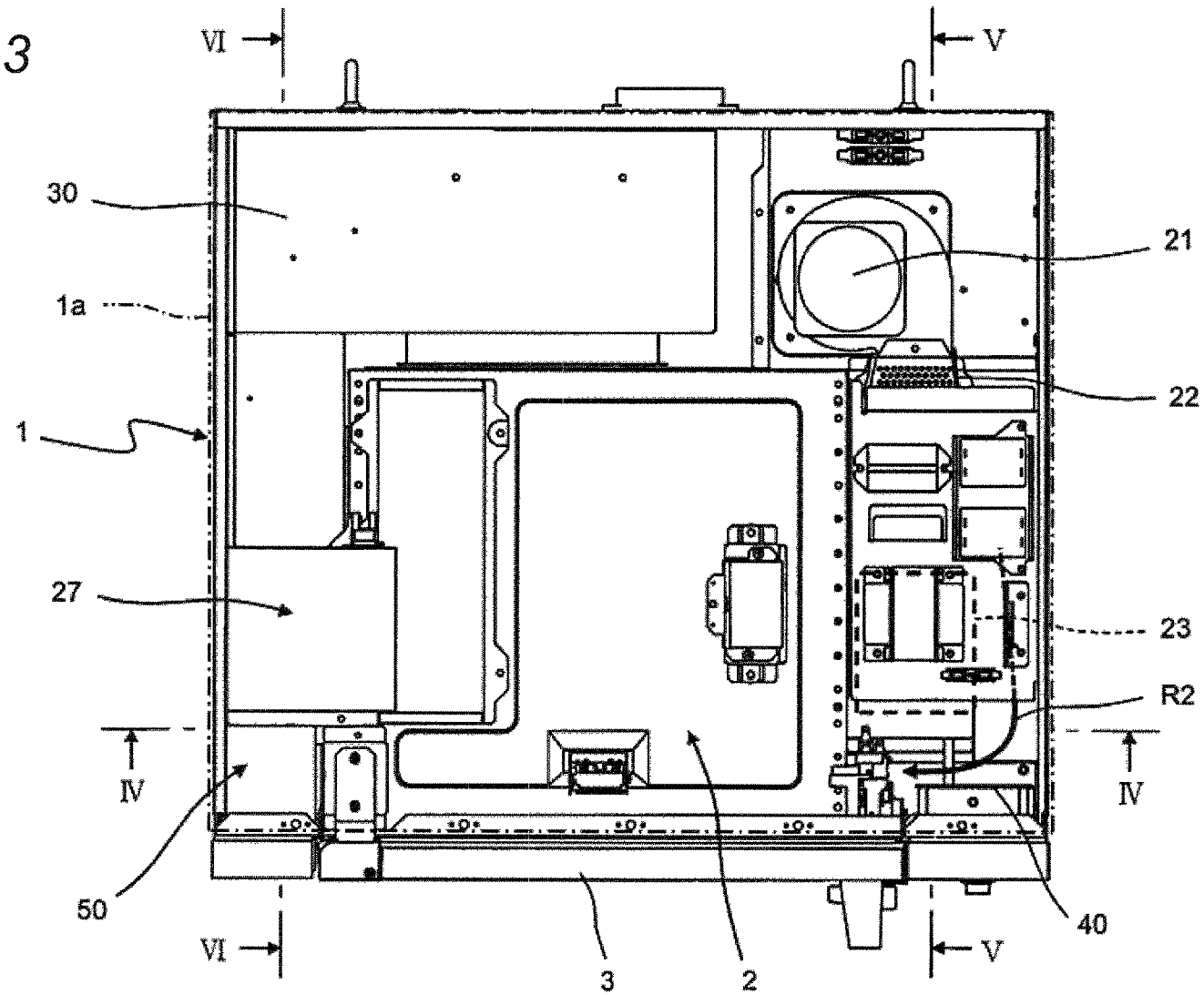
FIG. 3 is a plan view of the heating cooker in which the upper cover of the body casing has been removed.

FIG. 3 shows a plan view of the heating cooker in which the upper cover 1*a* of the body casing 1 has been removed and the same components in FIG. 3 as those in FIGS. 1 and 2 are provided with the same reference characters as those in the drawings.

As shown in FIG. 3, a power supply part 30 is provided on a rear face side of the heating chamber 2 in the body casing 1.

The cooling air flow having blown off from the blow-off ports 22*b* (shown in FIG. 2) of the blower duct 22 is guided, so as to flow toward the front face side in the body casing 1 without passing through the magnetron 23 and so as to turn around toward the heating chamber 2 (along an arrow R2) before reaching the display substrate 40, by the third guiding channel formed of the space surrounded by the portion of the blower duct 22, the right side surface of the housing of the magnetron 23, and the body casing 1. Thus an air curtain that covers the display substrate 40 on the front face side in the body casing 1 is formed. Then the cooling air flow prevents temperature increase by cooling inside of a right side wall of the body casing 1.

The third guiding channel that has gradually decreasing flow passage cross-sectional areas may be configured, for instance, so as to increase a flow velocity of the cooling air flow flowing toward the front face side in the body casing 1 without passing through the magnetron 23 and thus the air curtain can reliably be formed. In a configuration in which the cooling air flow having a temperature increased by passing through the magnetron 23 flows toward the front face side in the body casing 1, in particular, the air curtain can reliably be formed without obstruction by the cooling air having passed through the magnetron 23.

The third guiding channel may be formed so as to cause inflow into the power supply part 30 and cooling air flow having passed through the power supply part 30 thereafter flows into an air discharge duct 50.

Figure 4:
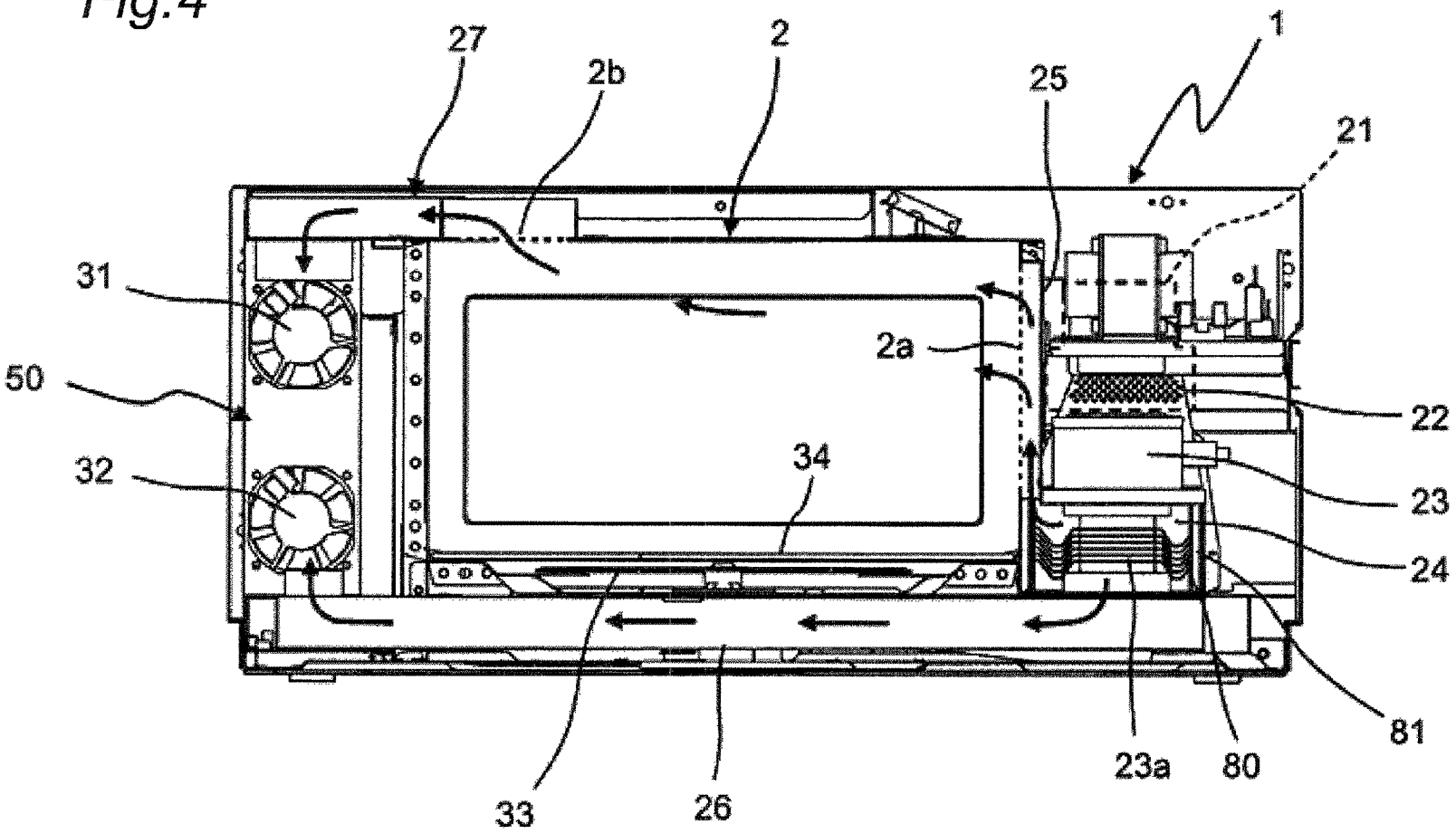
FIG. 4 is a vertical section taken along line IV-IV of FIG. 3.

FIG. 4 shows a vertical section which is taken along line IV-IV of FIG. 3 and the same components in FIG. 4 as those in FIGS. 1 through 3 are provided with the same reference characters as those in the drawings. In FIG. 4, reference numeral 33 denotes a rotating antenna for agitating microwaves from the magnetron 23 and numeral 34 denotes a bottom tray.

As shown in FIG. 4, the magnetron 23 includes a cooling channel 24 into which the cooling air flow from the cooling fan 21 (shown in FIGS. 2 and 3) flows through the blower duct 22, and cooling fins 23*a* which are provided in the cooling channel 24. A first guiding channel 25 is provided that provides communication between a downstream side of the cooling channel 24 of the magnetron 23 and inside of the heating chamber 2. By the first guiding channel 25, a portion of the cooling air flow from the cooling fan 21 that has flowed out to the downstream side after cooling the magnetron 23 is guided into the heating chamber 2. In the embodiment, a temperature of the cooling air that has passed through the magnetron 23 in operation is on the order of 150° C.

A second guiding channel 26 is provided that provides communication between the downstream side of the magnetron 23 and inside of the air discharge duct 50. By the second guiding channel 26, another portion of the cooling air flow from the cooling fan 21 that has flowed out to the downstream side after cooling the magnetron 23 is guided toward the air discharge duct 50. The cooling channel 24 in the magnetron 23 has a path 81, partitioned off with a partition plate 80, on the right side of the cooling fins 23*a* (see FIG. 11).

The air discharge duct 50 is provided at a position on the left side of the heating chamber 2 and the front face side in the body casing 1. A downstream end of the second guiding channel 26 is connected to underside of the air discharge duct 50.

The first guiding channel 25 and the second guiding channel 26 are configured so that a pressure loss in the cooling channel 24 in the magnetron 23 is greater than the sum of a pressure loss in the first guiding channel 25 and a pressure loss in the second guiding channel 26 and so that the pressure loss in the second guiding channel 26 is smaller than the pressure loss in the first guiding channel 25.

A chamber inside air discharge port 2*b* provided on a left side on the top face in the heating chamber 2 and an upper part of the air discharge duct 50 are connected by a connection duct 27. On a rear face side of the air discharge duct 50, air discharge fans 31 and 32 for blowing air from the rear face side into the air discharge duct 50 are provided.

Figure 5:
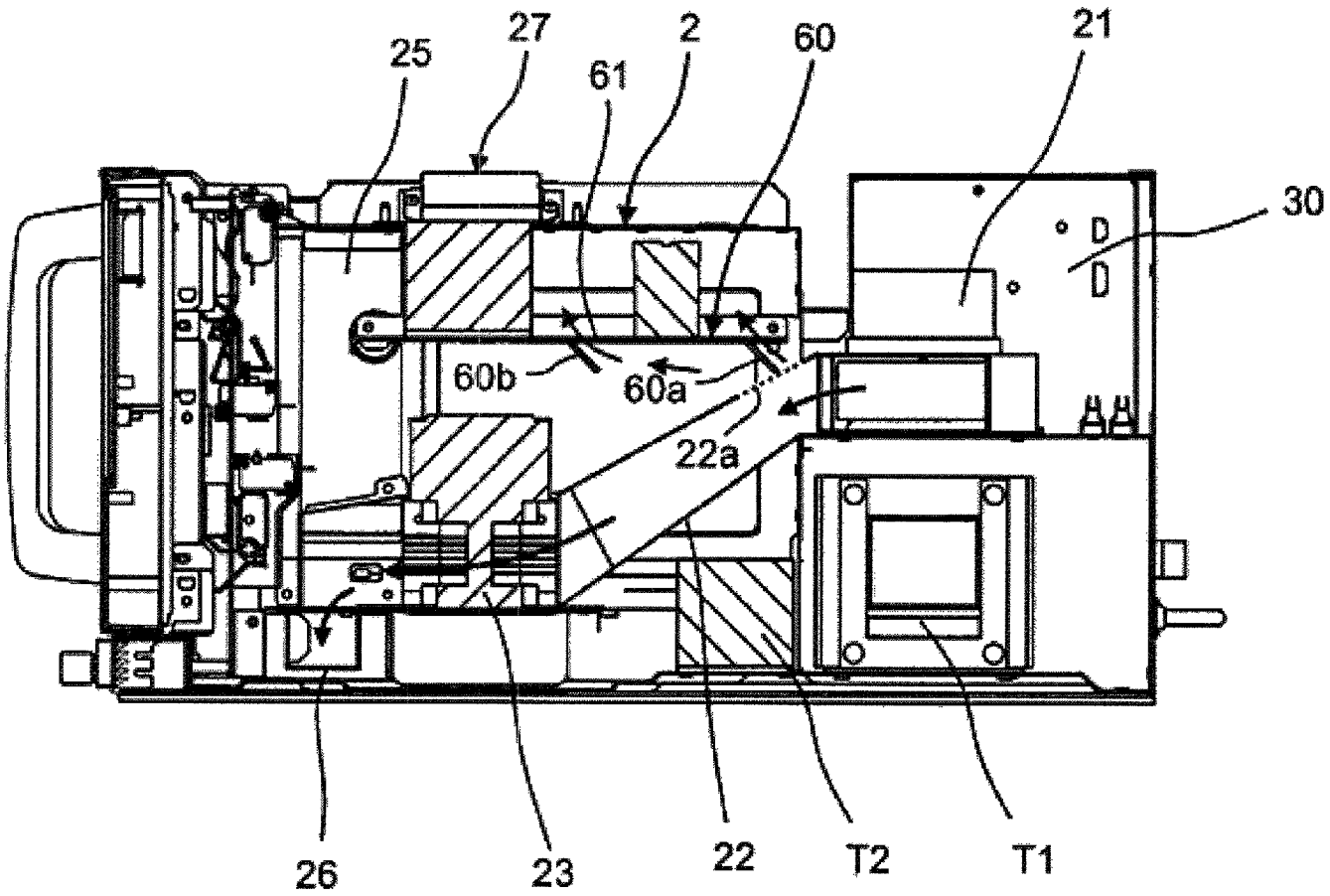
FIG. 5 is a vertical section taken along line V-V of FIG. 3.

FIG. 5 shows a vertical section taken along line V-V of FIG. 3 and the same components in FIG. 5 as those in FIGS. 1 through 4 are provided with the same reference characters as those in the drawings.

As shown in FIG. 5, a blow-off port 22*a* is provided in a vicinity of the cooling fan 21 on an upper part of the blower duct 22. The blow-off port 22*a* is formed of a plurality of circular holes.

The second guiding channel 26 communicating with the downstream side of the magnetron 23 is placed at a position under the heating chamber 2 and on the front face side.

A mounting plate 60 is horizontally placed over the magnetron 23 and over the blower duct 22 in the body casing 1. In the mounting plate 60, which is in shape of a rectangle long in a front-back direction, one of long sides is fixed to a side wall of the heating chamber 2 and the other of the long sides is fixed to a frame member 42 (shown in FIG. 2). Such electric components as transformers and relays that generate smaller amount of heat than the large amount of heat generated by the transformers T1 and T2 are fixed onto the mounting plate 60.

An inclined part 60*a* that is a rear side part of the mounting plate 60 bent diagonally downward with respect to a rearward direction is provided and an inclined part 60*b* that is bent diagonally downward with respect to the rearward direction by cutting and raising at center in general of the mounting plate 60 is provided so that an opening 61 is formed.

A portion of the blowing air flow having blown off from the blow-off ports 22*b* of the blower duct 22 flows along the inclined part 60*a* on the rear side of the mounting plate 60 and collides with the electric components on the mounting plate 60. Another portion of the blowing air having blown off from the blow-off ports 22*b* of the blower duct 22 flows along the inclined part 60*b* in a center part of the mounting plate 60, passes through the opening 61, and collides with the electric components on the mounting plate 60.

A fourth guiding channel is formed of the mounting plate 60 having the inclined parts 60*a*, 60*b* and the opening 61, and guides the portions of the cooling air from the cooling fan 21 so that the portions blow off to the top face side in the body casing 1.

Figure 6:
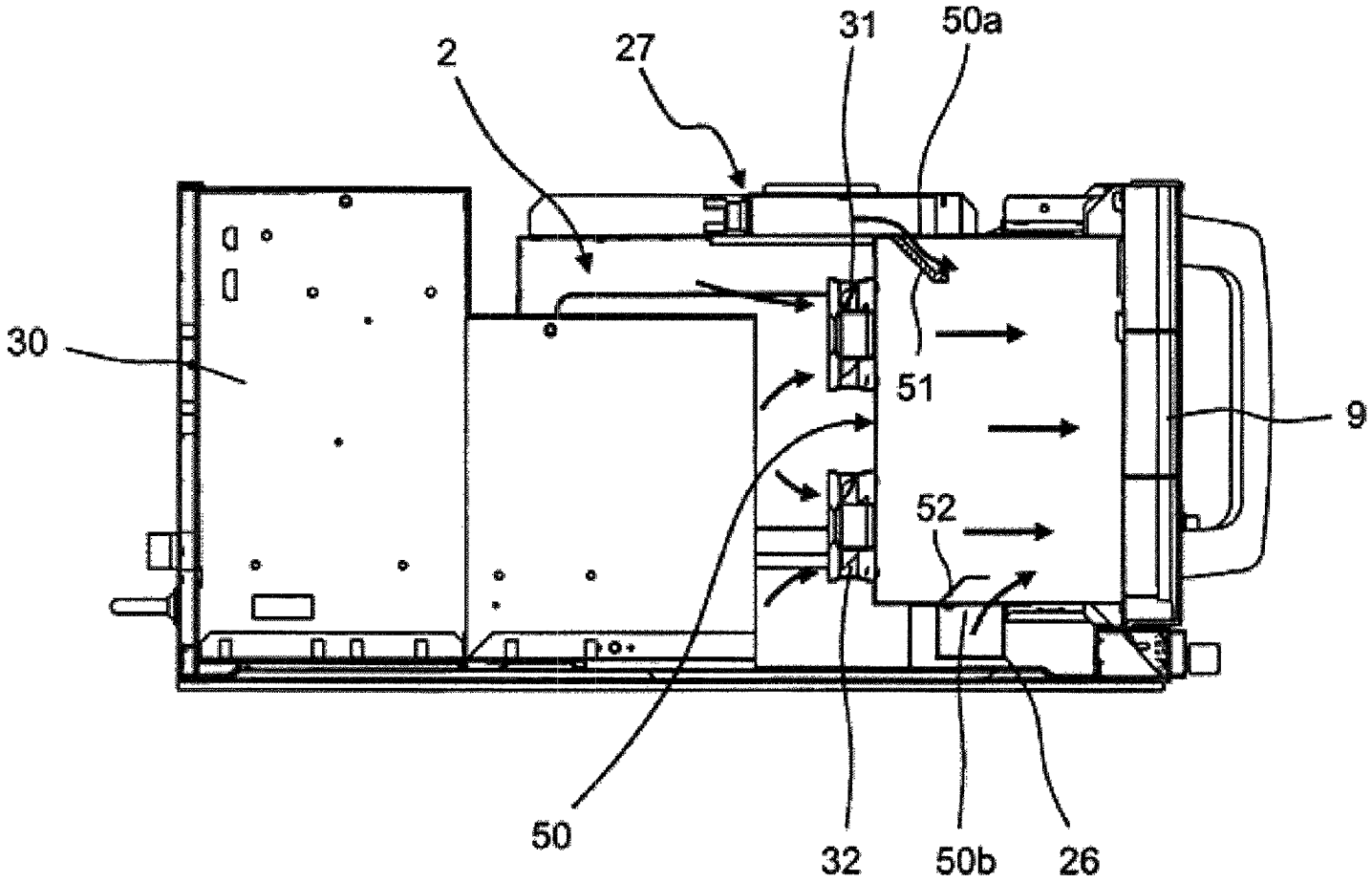
FIG. 6 is a vertical section taken along line VI-VI of FIG. 3.

FIG. 6 shows a vertical section taken along line VI-VI of FIG. 3 and the same components in FIG. 6 as those in FIGS. 1 through 5 are provided with the same reference characters as those in the drawings.

As shown in FIG. 6, a downstream end of the connection duct 27 is connected to a connection port 50*a* provided on the upper part of the air discharge duct 50 and the downstream end of the second guiding channel 26 is connected to a connection port 50*b* provided on a lower part of the air discharge duct 50. The connection port 50*a* in the air discharge duct 50 is provided with an inclined member 51 that is inclined from a rear edge side of the connection port 50*a* toward the front face side and downward. The connection port 50*b* in the air discharge duct 50 is provided with an inclined member 52 that is inclined from a rear edge side of the connection port 50*b* toward the front face side and upward.

By the air discharge fans 31 and 32 provided on the rear face side of the air discharge duct 50, the cooling air flow delivered into the air discharge duct 50 is mixed with discharge air discharged through the connection port 50*a* and with the dry cooling air flow having flowed in through the connection port 50*b* and is then discharged frontward from the air discharge port 9. Then the discharge air discharged from the heating chamber 2 and having a high temperature and a high humidity is diluted in the air discharge duct 50 with the cooling air flow with a low humidity having cooled the magnetron 23 and with the cooling air flow from the air discharge fans 31 and 32 and the temperature and the humidity of the discharge air can consequently be decreased.

The inclined member 51 formed of heat insulator (or a member provided with an air heat-insulating layer as an intermediate layer) prevents condensation of the discharge air having the high temperature and the high humidity on an upper surface of the inclined member 51 when a lower side of the inclined member 51 is cooled by the cooling air flow supplied by the air discharge fans 31.

In the inclined member 51 formed with provision of the air heat-insulating layer, the air heat-insulating layer may be formed as a closed air layer or may be open to the air discharge duct 50 or, in other words, has only to be configured so that the cooling air flow supplied by the air discharge fan 31 may not collide with wall surface parts with which the discharge air discharged from the heating chamber 2 collides.

An ejector part is formed in the air discharge duct 50 by provision of the inclined member 51 and the inclined member 52 in the air discharge duct 50. By the ejector part, the cooling air flow that flows into the air discharge duct 50 under guidance of the second guiding channel 26 and the discharge air from the inside of the heating chamber 2 are drawn into the air discharge duct 50.

In a mixing part on the downstream side of the ejector part in the air discharge duct 50, effects of mixing and dilution are enhanced with increase in an inner volume thereof and with increase in a distance from the ejector part to the air discharge port 9.

By extension of the inclined members 51 and 52, forming the ejector part, to positions facing the air discharge fans 31 and 32, respectively, directions of the cooling air flows that blow from the air discharge fans 31 and 32 are changed to directions toward center so that collision of the cooling air flows are caused. By turbulent flow generated by the collision, the cooling air flow that flows into the air discharge duct 50 under the guidance of the second guiding channel 26 and the discharge air from the inside of the heating chamber 2 can efficiently be mixed.

Figure 7:
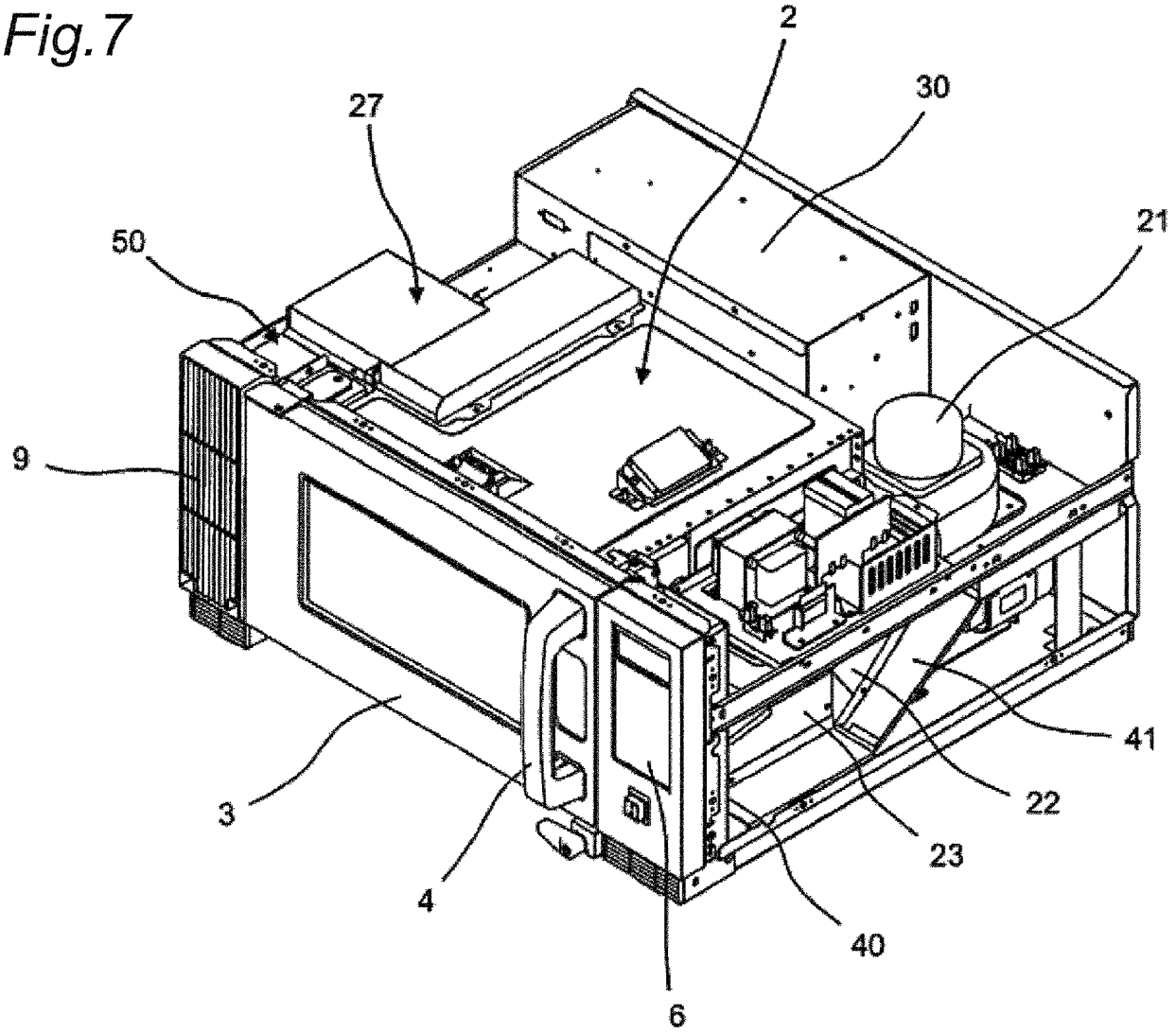
FIG. 7 is a perspective view of the heating cooker as seen looking diagonally from upper right on a front side.

FIG. 7 shows a perspective view of the heating cooker as seen looking diagonally from upper right on a front side and the same components in FIG. 7 as those in FIGS. 1 through 6 are provided with the same reference characters as those in the drawings.

As shown in FIG. 7, a partition plate 41 is placed under the blower duct 22 and along a bottom face of the blower duct 22. By the partition plate 41 that partitions a space on the right side in the body casing 1 into a front side and a rear side under the blower duct 22, a space on the rear side of the partition plate 41 is defined on the upstream side, that is, a suction side of the cooling fan 21, and a space on the front side of the partition plate 41 is defined on the downstream side, that is, a blow-off side of the cooling fan 21. Outside air is sucked through the air intake ports 10 (shown in FIG. 1) provided on the front face of the body casing 1 and through a space under the heating chamber 2 into the suction port (not shown) under the cooling fan 21. Thus the electric components such as the transformers T1 and T2 (shown in FIGS. 2 and 5) that are placed in the space at rear of the partition plate 41 and the blower duct 22 and that generate high heat can be cooled by the cooling air (outside air) with a low temperature that is sucked by the cooling fan 21 through the air intake ports 10.

Figure 8:
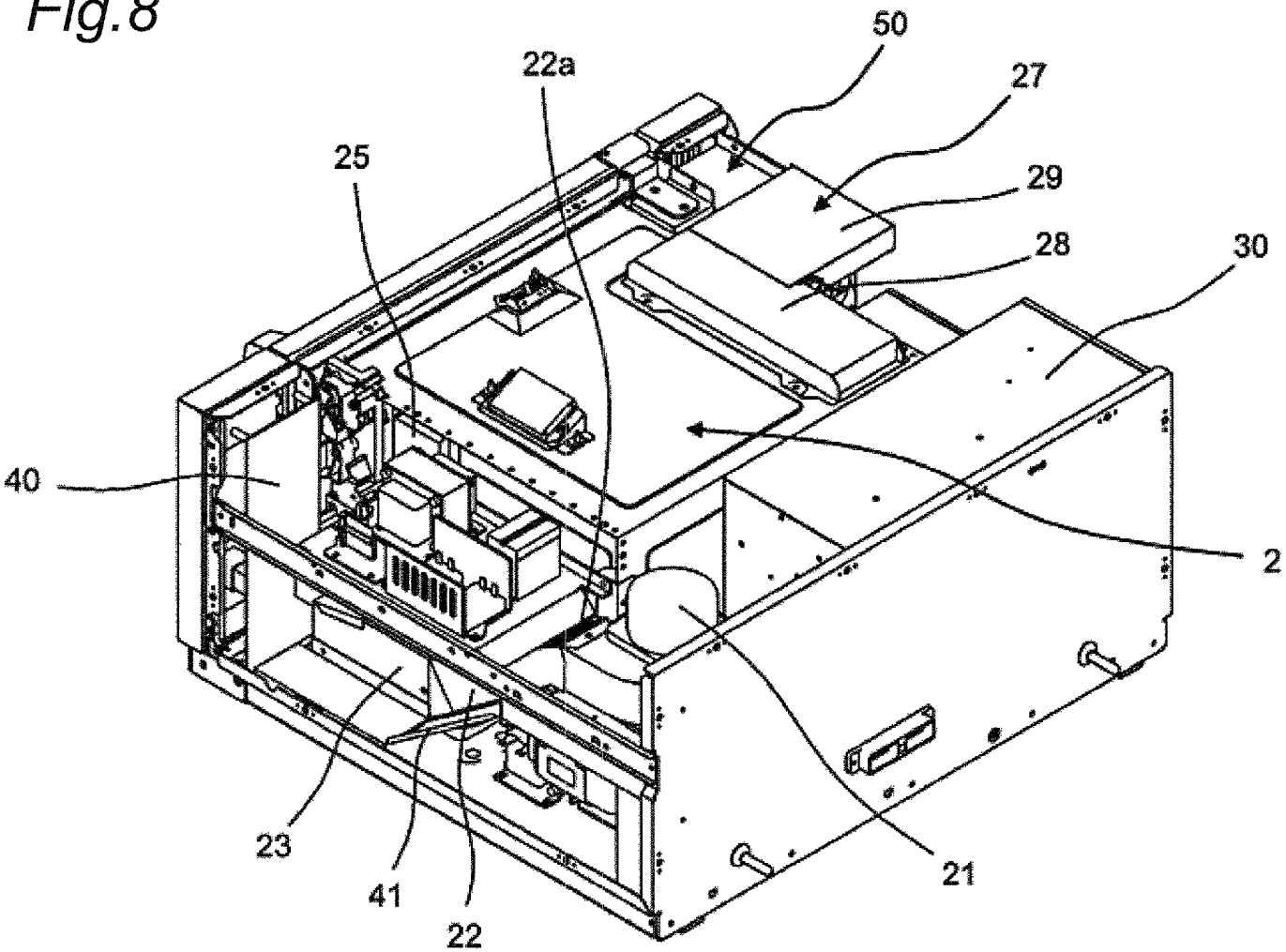
FIG. 8 is a perspective view of the heating cooker as seen looking diagonally from upper right on a rear side.
Figure 9:
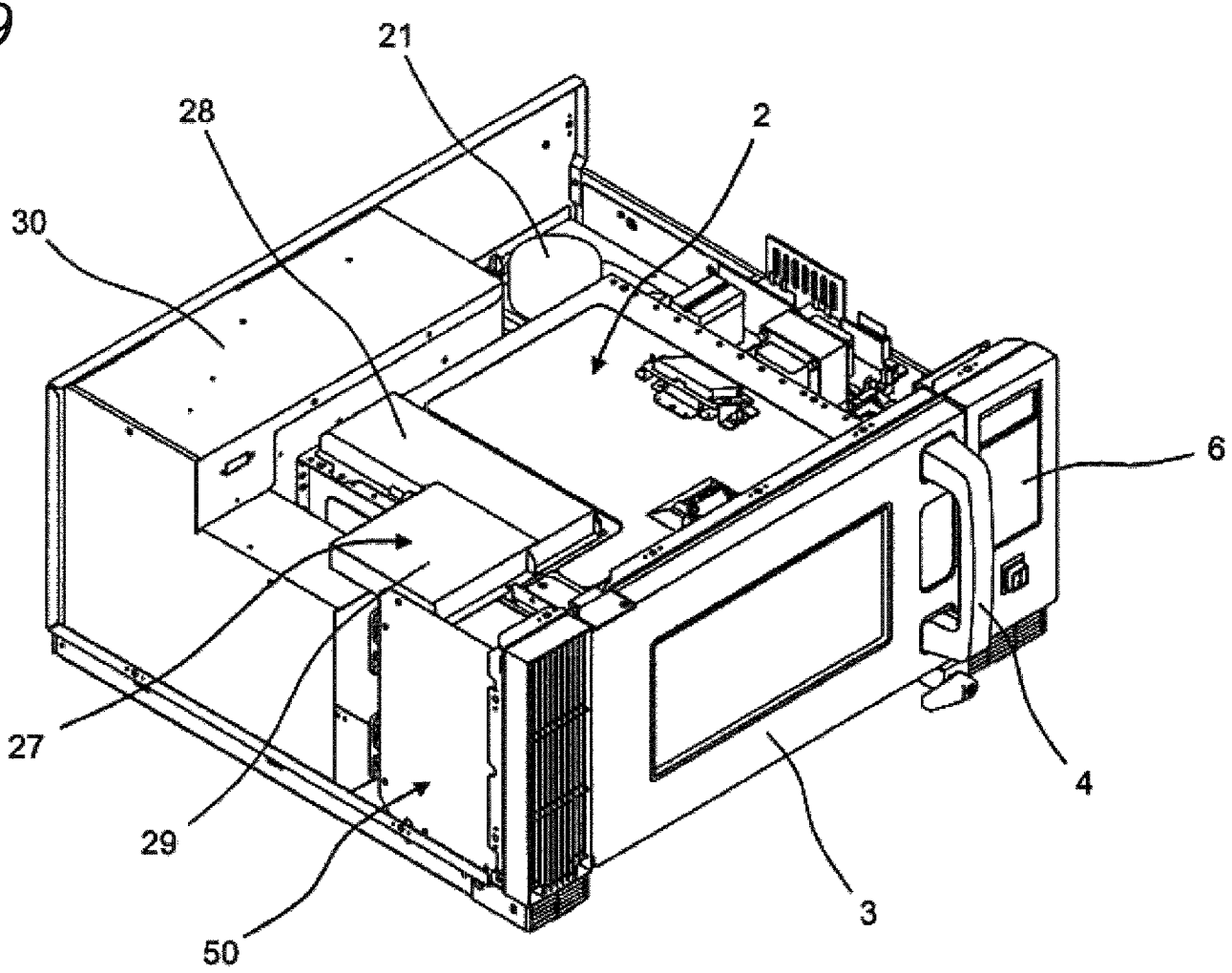
FIG. 9 is a perspective view of the heating cooker as seen looking diagonally from upper left on the front side.

FIG. 8 shows a perspective view of the heating cooker as seen looking diagonally from above on the rear side and FIG. 9 shows a perspective view of the heating cooker as seen looking diagonally from upper left on the front side, the same components in FIGS. 8 and 9 as those in FIGS. 1 through 7 are provided with the same reference characters as those in the drawings.

As shown in FIGS. 8 and 9, the connection duct 27 connected to the chamber inside air discharge port 2*b* (shown in FIG. 4) provided on the left side on the top face in the heating chamber 2 includes a linear part 28 extending in the front-back direction and a bent part 29 bent from a front side of the linear part 28 toward a left side thereof. A part of the bent part 29 on underside and a front face side is connected to the connection port 50*a* (shown in FIG. 6) of the air discharge duct 50.

Figure 10:
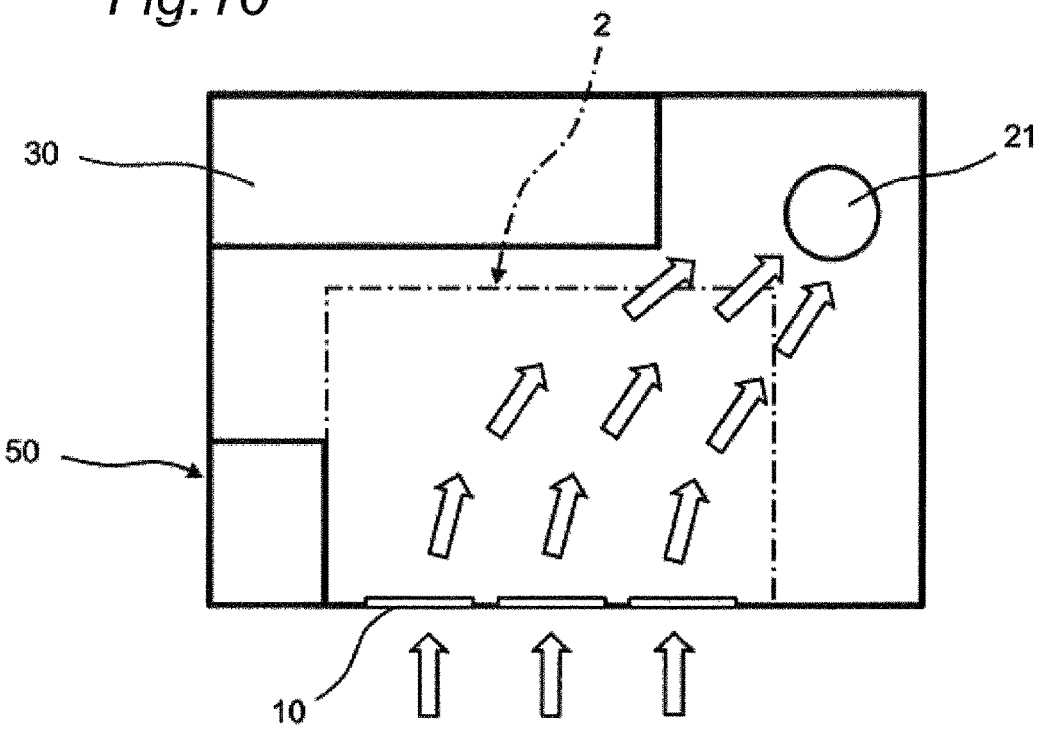
FIG. 10 is a schematic top plan view of the heating cooker for illustration of suction paths for a cooling fan.

FIG. 10 shows a schematic top plan view of the heating cooker for illustration of suction paths for the cooling fan 21 and the outside air is sucked by the cooling fan 21 from the front face side through the air intake ports 10 provided on the front face of the body casing 1. The outside air sucked from the air intake ports 10 flows toward the rear face side through the space under the heating chamber 2 between a bottom part of the body casing 1 and the second guiding channel 26 and flows into the suction port under the cooling fan 21 provided on a rear right side in the body casing 1. Then the electric components such as the transformers T1 and T2 (shown in FIGS. 2 and 5) that are placed on the bottom plate of the body casing 1 and that generate high heat are cooled by the outside air with the low temperature that is sucked into the cooling fan 21.

Figure 11:
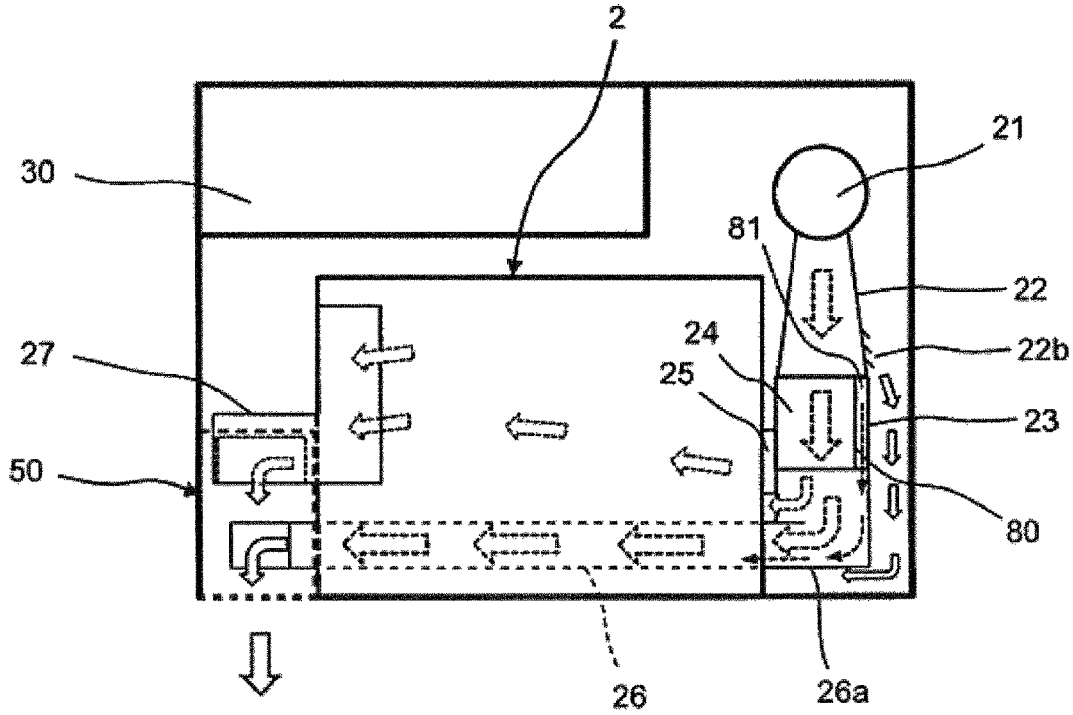
FIG. 11 is a schematic top plan view of the heating cooker for illustration of blow-off paths for the cooling fan.

FIG. 11 shows a schematic top plan view of the heating cooker for illustration of blow-off paths for the cooling fan 21 in which the portion of the cooling air having blown off from the cooling fan 21 and having passed through the blower duct 22 and the magnetron 23 is guided into the first guiding channel 25 and in which the remaining portion thereof is guided into the second guiding channel 26. The cooling air guided through the first guiding channel 25 into the heating chamber 2 flows through the heating chamber 2 and is discharged through the connection duct 27 toward the air discharge duct 50. The cooling air guided through the second guiding channel 26 into the air discharge duct 50, together with the cooling air flow from the air discharge fans 31 and 32 (shown in FIGS. 4 and 6), is mixed with the discharge air from the inside of the heating chamber 2 and is then discharged frontward.

The cooling channel 24 in the magnetron 23 has the path 81, partitioned off with the partition plate 80, on the right side of the cooling fins 23*a*. The cooling air from the cooling fan 21 passes through the path 81 without modification and flows along an inner wall at an entrance of the second guiding channel 26, so as to attain prevention of temperature increase in a front face wall part 26*a* of the second guiding channel 26 and suppression of temperature increase in the display substrate 40 (shown in FIGS. 2 and 3) on a front face side of the front face wall part 26*a* and the like.

The cooling air having blown off from the blow-off ports 22*b* of the blower duct 22 is guided so as to flow on a lateral side without passing through the cooling channel 24 in the magnetron 23 and so as to blow off toward the front face side in the body casing 1 (third guiding channel). Though not shown, the cooling air having blown off from the blow-off port 22*a* (shown in FIG. 5) of the blower duct 22 toward the top face side in the body casing collides with the electric components on the mounting plate 60 (fourth guiding channel). The cooling air having blown off from the blow-off ports 22*a* and 22*b* of the blower duct 22 cools the display substrate 40 (shown in FIGS. 2 and 3) and other electric components, thereafter flows smoothly along side surfaces, the top surface, and a back surface of the heating chamber 2 to the rear face side of the air discharge duct 50 while joining, and is sucked into the air. discharge fans 31 and 32.

A region of the suction paths for the cooling fan 21 that is shown in FIG. 10 and a region of the blow-off paths for the cooling fan 21 that has been illustrated with reference to FIG. 11 are separated or generally isolated from each other so as to prevent re-suction through the blow-off paths for the cooling fan 21 into the cooling fan 21 in the body casing 1.

According to the heating cooker having an above configuration, the portion of the cooling air flow from the cooling fan 21 provided in the body casing 1 that has flowed out to the downstream side after cooling the magnetron 23 is guided into the heating chamber 2 by the first guiding channel 25 and another portion of the cooling air flow from the cooling fan 21 that has flowed out to the downstream side after cooling the magnetron 23 is guided toward the air discharge duct 50 by the second guiding channel 26. Thus air can be supplied into the heating chamber 2 with utilization of the cooling air flow having cooled the magnetron 23 in the simple configuration and supply of the air into the heating chamber 2 and cooling of the magnetron 23 can be carried out by the one cooling fan 21. By placement of the electric components on the upstream side of the cooling fan 21, efficient cooling of the electric components can be attained and performance of cooling the electric components by the cooling fan 21 can be improved.

In addition, the portion (arrow R1 in FIG. 2) of the cooling air flow from the cooling fan 21 is guided so as to blow off toward the front face side in the body casing 1 without passing through the cooling channel 24 in the magnetron 23, by the third guiding channel defining the space surrounded by the portion of the blower duct 22, the right side surface of the housing of the magnetron 23, and the body casing 1. Thus the front face side in the body casing 1, or the display substrate 40 and the like placed on the front face side can be cooled by the cooling air flow having the low temperature that is separate from the cooling air flow having the temperature increased by the cooling of the magnetron 23.

The air curtain is formed on the front face side in the body casing 1 by the portion (arrow R1 in FIG. 2) of the cooling air flow guided by the third guiding channel from the cooling fan 21 and the temperature increase in the display substrate 40 and the like provided on the front face side can be suppressed by covering with the air curtain.

The portion of the cooling air from the cooling fan 21 is guided, so as to blow off toward the top face side in the body casing 1, by the fourth guiding channel formed of the mounting plate 60 having the inclined parts 60*a*, 60*b* and the opening 61, and thus the electric components placed on the top face side in the body casing 1 can be cooled by the cooling air flow having the low temperature that is separate from the air flow having the temperature increased by the cooling of the magnetron 23.

The outside air is sucked by the cooling fan 21 from the front face side through the air intake ports 10 provided on the front face of the body casing 1 and thus the heating cooker is suitable as a heating cooker that is of built-in type and that is installed in an environment where air can be taken in only from the front face side.

The pressure loss in the cooling channel 24 in the magnetron 23 through which the cooling air flow from the cooling fan 21 flows is greater than the sum of the pressure loss in the first guiding channel 25 and the pressure loss in the second guiding channel 26 and thus the cooling air flow smoothly flows through the cooling channel 24 in the magnetron 23 because the cooling air flow having passed through the cooling channel 24 in the magnetron 23 flows out into the first and second guiding channel 25 and 26 in which the summed pressure loss is smaller than that in the cooling channel 24, so that cooling efficiency for the magnetron 23 is improved.

The pressure loss in the second guiding channel 26 is smaller than the pressure loss in the first guiding channel 25 and thus the cooling air flow that flows through the second guiding channel 26 toward the air discharge duct 50 surpasses in amount the cooling air flow that flows through the first guiding channel 25 into the heating chamber 2, so that excessive air is prevented from being supplied into the heating chamber 2. Though supply of an excessive amount of air into the heating chamber 2 might cause drying of food that is the objects to be heated, decrease in a temperature of the food, and/or the like, steam generated in the heating chamber 2 can be discharged by supply of such an amount of air as to prevent the drying, temperature decrease and the like in food being heated by microwaves.

The cooling air flow from the cooling fan 21 is guided by the blower duct 22 into the cooling channel 24 in the magnetron 23, so that a principal component of the cooling air flow from the cooling fan 21 can be supplied into the cooling channel 24 in the magnetron 23, and thus the cooling efficiency for the magnetron 23 is further improved.

The portion of the cooling air flow from the cooling fan 21 provided in the body casing 1 that has flowed out to the downstream side after cooling the magnetron 23 is guided into the heating chamber 2 by the first guiding channel 25 and another portion of the cooling air flow from the cooling fan 21 that has flowed out to the downstream side after cooling the magnetron 23 is guided toward the air discharge duct 50 by the second guiding channel 26. The discharge air from the inside of the heating chamber 2 and the cooling air flow guided by the second guiding channel 26 are mixed in the air discharge duct 50 and are then discharged. The cooling air flow guided through the first guiding channel 25 into the heating chamber 2 flows, as the discharge air from the inside of the heating chamber 2, through the connection duct 27 toward the air discharge duct 50. That is, the cooling air flow divided into the two portions by the first and second guiding channel 25 and 26 after passing through the magnetron 23 from the cooling fan 21 joins again in the air discharge duct 50 and is then discharged. The cooling air flow guided by the second guiding channel 26 after cooling the magnetron 23 has the low humidity and the temperature of the cooling air flow is decreased by passage of the cooling air flow through the second guiding channel 26. Thus the discharge air from the inside of the heating chamber 2 can be discharged while the temperature and humidity of the discharge air are efficiently decreased with the utilization of the cooling air flow having cooled the magnetron 23.

Second Embodiment

Figure 12:
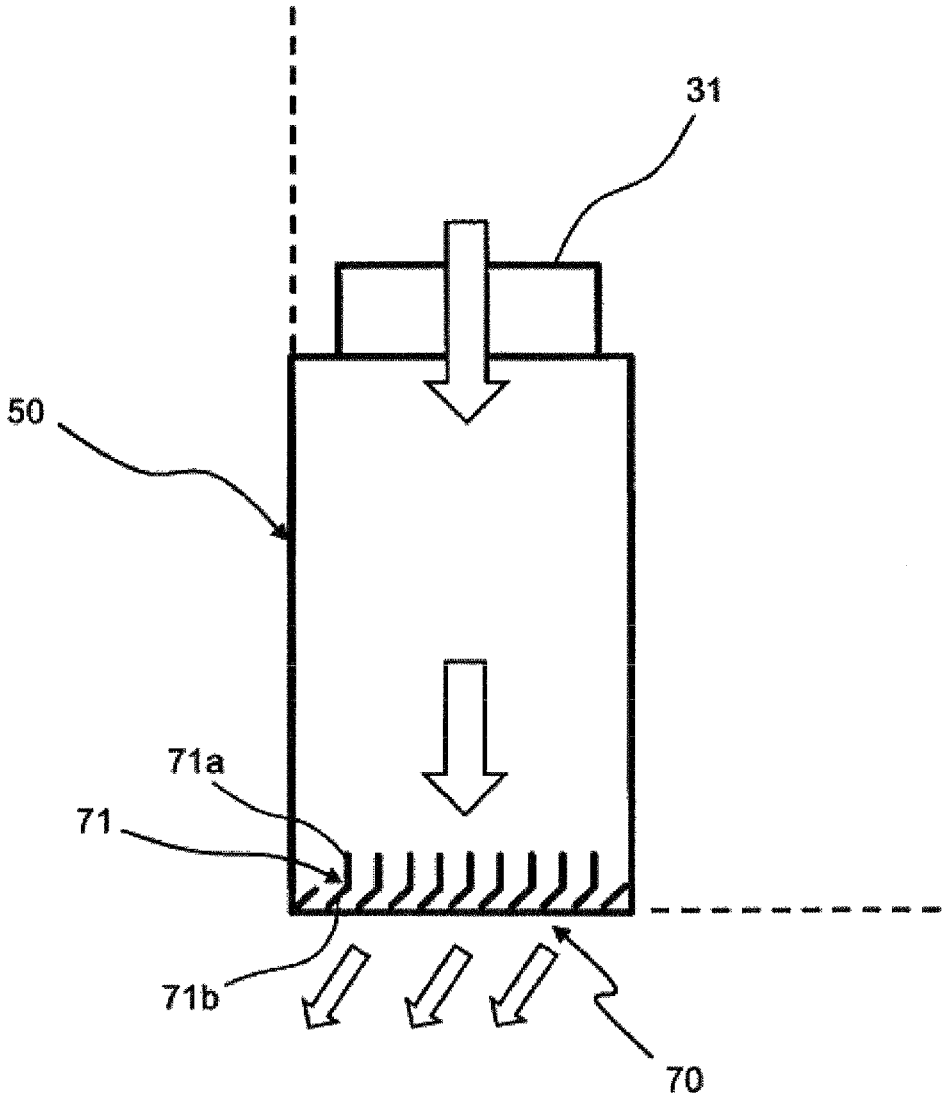
FIG. 12 is a schematic top plan view of an air discharge duct of a heating cooker in accordance with a second embodiment of the invention.

FIG. 12 shows a schematic top plan view of the air discharge duct 50 of a heating cooker in accordance with a second embodiment of the invention. The heating cooker in accordance with the second embodiment has the same configuration as the heating cooker in accordance with the first embodiment has, except for a drag part in the air discharge port 9 of the air discharge duct 50, and FIGS. 1 through 11 will be reused therefor. In the heating cooker in accordance with the second embodiment, as shown in FIG. 12, a blow-off grill 70 as an example of the drag part is provided in the air discharge port 9 of the air discharge duct 50. In the blow-off grill 70, a plurality of vertical bars 71 are placed in parallel with spacing in a lateral direction. The plurality of vertical bars 71 each have a horizontal section shaped like a dogleg and each includes a linear shape part 71*a* extending in the front-back direction and a bent shape part 71*b* bent diagonally from a front end of the linear shape part 71*a* toward a front left side.

According to the heating cooker of the second embodiment, a flow velocity in the air discharge duct 50 is decreased by the blow-off grill 70 (drag part) provided in the air discharge port 9 on a downstream side in the air discharge duct 50 and thus the mixing and dilution of the discharge air from the inside of the heating chamber 2 and the cooling air flow guided by the second guiding channel 26 are promoted before discharge through the air discharge port 9.

The air discharge port on the downstream side in the air discharge duct 50 is provided on the front face side of the body casing 1 so that the discharge air mixed in the air discharge duct 50 blows off toward a side (front left side in the embodiment) opposed to the air intake ports 10 provided on the front face side of the body casing and thus the discharge air discharged from the air discharge port 9 of the air discharge duct 50 can be inhibited from being sucked again into the air intake ports 10. By such prevention of resuction, decrease in the cooling efficiency for the electric components in the body casing 1 can be prevented.

The heating cooker in accordance with the second embodiment achieves effects similar to effects of the heating cooker in accordance with the first embodiment.

Though the blow-off grill 70 in which the plurality of vertical bars 71 are placed in parallel and with the spacing in the lateral direction is provided as the drag part in the air discharge port 9 of the air discharge duct 50 in the heating cooker, a form of the drag part is not limited thereto.

Third Embodiment

Figure 13:
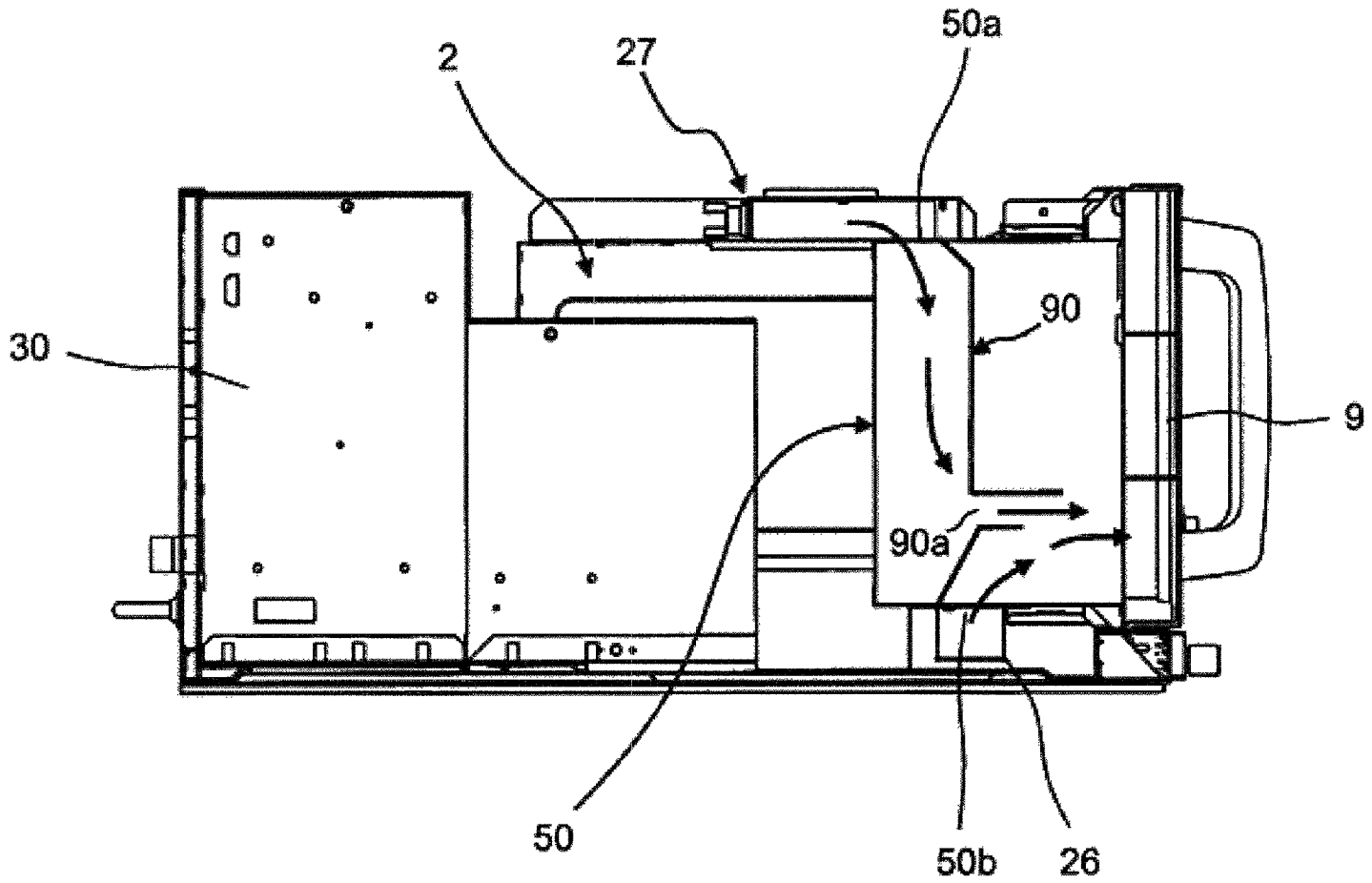
FIG. 13 is a vertical section of major parts of a heating cooker in accordance with a third embodiment of the invention.

FIG. 13 is a vertical section of major parts of a heating cooker in accordance with a third embodiment of the invention, as another example, taken along line VI-VI of FIG. 3. The same components in FIG. 13 as those in FIGS. 1 through 5 are provided with the same reference characters as those in the drawings.

In the heating cooker in accordance with the third embodiment, as shown in FIG. 13, an ejector part 90 having a suction port 90*a* is formed in the air discharge duct 50.

The heating cookers in which the air discharge fans 31 and 32 are provided in the air discharge duct 50 have been described as the first and second embodiments, whereas, in the heating cooker in accordance with the third embodiment of the invention, blowing capacity of the cooling fan 21 is increased without employment of the air discharge fans and the discharge air from the inside of the heating chamber 2 is drawn to the downstream side in the air discharge duct 50, through agency of the ejector part 90 provided in the air discharge duct 50, by the cooling air flow flowing into the air discharge duct 50 under the guidance of the second guiding channel 26. Thus the discharge air from the inside of the heating chamber 2 and the cooling air flow guided by the second guiding channel 26 are mixed by the ejector part 90 and are then discharged through the air discharge port 9.

In a mixing part on the downstream side of the ejector part 90 in the air discharge duct 50, the effects of the mixing and dilution are enhanced with increase in an inner volume of the mixing part and with increase in a distance from the ejector part 90 to the air discharge port 9.

According to the heating cooker of the third embodiment, the discharge air from the inside of the heating chamber 2 and the cooling air flow guided by the second guiding channel 26 can be mixed without necessity to employ the air discharge fans in the air discharge duct 50 and thus a configuration thereof can be simplified.

The cooling air flow from the second guiding channel 26 that flows into the air discharge duct 50 is higher in flow velocity than the discharge air from the inside of the heating chamber 2 that flows into the air discharge duct 50 and thus an ejector effect can be increased that causes the discharge air from the inside of the heating chamber 2 to be drawn into the air discharge duct 50 by the ejector part 90.

The heating cooker in accordance with the third embodiment achieves effects similar to the effects of the heating cooker in accordance with the first embodiment.

Fourth Embodiment

A heating cooker in accordance with a fourth embodiment of the invention has the same configuration as the heating cooker in accordance with the first embodiment has, except for a guiding part in the air discharge duct 50, and FIGS. 1 through 11 will be reused therefor.

According to the heating cooker of the fourth embodiment, when steam included in the discharge air from the inside of the heating chamber 2 condenses in the air discharge duct 50, dew condensation water accumulated in a bottom part of the air discharge duct 50 is guided into the second guiding channel 26 by the guiding part and can be evaporated in the second guiding channel 26 by the dry cooling air flow having the temperature increased by the cooling of the magnetron 23.

As the guiding part, for instance, an inclined surface is provided on the bottom part of the air discharge duct 50 so as to gradually lower toward the connection port 50*b* which is provided on the lower part of the air discharge duct 50 and to which the downstream end of the second guiding channel 26 is connected and the inclined surface guides the dew condensation water, accumulated in the bottom part of the air discharge duct 50, into the second guiding channel 26.

The heating cooker in accordance with the fourth embodiment achieves effects similar to the effects of the heating cooker in accordance with the first embodiment.

The heating cookers that are configured so that the cooling air flow having flowed out to the downstream side after cooling the magnetron 23 flows only into the first guiding channel 25 and the second guiding channel 26 have been described as the first through fourth embodiments, whereas the invention is not limited thereto and may be applied to heating cookers that are configured so that the cooling air flow having flowed out to the downstream side after cooling the magnetron also flows into channels other than the first and second guiding channels.

Among heating cookers of the invention are not only microwaves of microwave heating type but also heating cookers such as microwave ovens using overheated steam (or saturated steam) and microwave ovens not using overheated steam (or saturated steam), for instance.

Though the discharge air from the inside of the heating chamber 2 and the cooling air flow guided by the second guiding channel 26 are mixed in the air discharge duct 50 and are then discharged to the outside in the first through fourth embodiments, the discharge air from the inside of the heating chamber 2 and the cooling air flow guided by the second guiding channel 26 may separately be discharged to the outside.

Though the specific embodiments of the invention have been described, the invention is not limited to the first through fourth embodiments and can be embodied with modification in various ways within the scope of the invention.

The invention and the embodiments will be summarized as follows.

The heating cooker of the invention includes the body casing 1, the heating chamber 2 that is placed in the body casing 1, the magnetron 23 that is placed in the body casing 1 and that supplies the microwaves into the heating chamber 2, the cooling fan 21 that is placed in the body casing 1 and that delivers the cooling air flow to the magnetron 23, the air discharge duct 50 that is for discharging the discharge air from the inside of the heating chamber 2 to the outside, the first guiding channel 25 that guides into the heating chamber 2 the portion of the cooling air flow from the cooling fan 21 which has flowed out to the downstream side after cooling the magnetron 23, and the second guiding channel 26 that guides toward the air discharge duct 50 another portion of the cooling air flow from the cooling fan 21 which has flowed out to the downstream side after cooling the magnetron 23.

According to an above configuration, the portion of the cooling air flow from the cooling fan 21 placed in the body casing 1 that has flowed out to the downstream side after cooling the magnetron 23 is guided into the heating chamber 2 by the first guiding channel 25 and another portion of the cooling air flow from the cooling fan 21 that has flowed out to the downstream side after cooling the magnetron 23 is guided toward the air discharge duct 50 by the second guiding channel 26. Thus the air can be supplied into the heating chamber 2 with the utilization of the cooling air flow having cooled the magnetron 23 in the simple configuration, and the supply of the air into the heating chamber 2 and the cooling of the magnetron 23 can be carried out by the one cooling fan 21. By the placement of the electric components on the upstream side of the cooling fan 21, the efficient cooling of the electric components can be attained and thus the performance of cooling the electric components by the cooling fan 21 can be improved.

The heating cooker in accordance with the embodiment further includes the third guiding channel that guides the portion of the cooling air flow from the cooling fan 21 so that the portion blows off toward the front face side in the body casing 1 without passing through the cooling channel 24 in the magnetron 23.

According to the embodiment, the portion of the cooling air flow from the cooling fan 21 is guided, so as to blow off toward the front face side in the body casing 1 without passing through the cooling channel 24 in the magnetron 23, by the third guiding channel and thus the front face side in the body casing 1, or the display part and the like placed on the front face side, can be cooled by the cooling air flow having the low temperature that is separate from the air flow having the temperature increased by the cooling of the magnetron 23.

In the heating cooker in accordance with the embodiment, the air curtain is formed on the front face side in the body casing 1 by the portion of the cooling air flow guided by the third guiding channel from the cooling fan 21.

According to the embodiment, the air curtain is formed on the front face side in the body casing 1 by the portion of the cooling air flow guided by the third guiding channel from the cooling fan 21 and the hot air flow having cooled the magnetron 23 and having the temperature increased can be inhibited by the air curtain from colliding with the front face side, so that temperatures of the display part and the like provided on the front face side can be prevented from being increased by the hot air flow.

The heating cooker in accordance with the embodiment further includes the fourth guiding channel that guides the portion of the cooling air from the cooling fan 21 so that the portion blows off toward the top face side in the body casing 1.

According to the embodiment, the portion of the cooling air from the cooling fan 21 is guided so as to blow off toward the top surface side in the body casing 1 by the fourth guiding channel and thus the electric components placed on the top face side in the body casing 1 can be cooled by the cooling air flow having the low temperature that is separate from the air flow having the temperature increased by the cooling of the magnetron 23.

The heating cooker in accordance with the embodiment further includes the air intake ports 10 provided on the front face side of the body casing 1 and the cooling fan 21 sucks the outside air from the front face side through the air intake ports 10.

According to the embodiment, the outside air is sucked by the cooling fan 21 from the front face side through the air intake ports 10 provided on the front face of the body casing 1 and thus the embodiment can be applied to a heating cooker that is of built-in type and that is installed in an environment where air can be taken in only from the front face side.

In the heating cooker in accordance with the embodiment, the pressure loss in the cooling channel 24 in the magnetron 23 through which the cooling air flow from the cooling fan 21 flows is greater than the sum of the pressure loss in the first guiding channel 25 and the pressure loss in the second guiding channel 26.

According to the embodiment, the pressure loss in the cooling channel 24 in the magnetron 23 through which the cooling air flow from the cooling fan 21 flows is greater than the sum of the pressure loss in the first guiding channel 25 and the pressure loss in the second guiding channel 26 and thus the cooling air flow smoothly flows through the cooling channel 24 in the magnetron 23 because the cooling air flow having passed through the cooling channel 24 in the magnetron 23 flows out into the first and second guiding channel 25 and 26 in which the summed pressure loss is smaller, so that the cooling efficiency for the magnetron 23 is improved.

In the heating cooker in accordance with the embodiment, the pressure loss in the second guiding channel 26 is smaller than the pressure loss in the first guiding channel 25.

According to the embodiment, the pressure loss in the second guiding channel 26 is smaller than the pressure loss in the first guiding channel 25 and thus the cooling air flow that flows through the second guiding channel 26 toward the air discharge duct 50 surpasses in amount the cooling air flow that flows through the first guiding channel 25 into the heating chamber 2, so that the excessive air is prevented from being supplied into the heating chamber 2. Though the supply of excessive amount of air into the heating chamber 2 might cause the drying of food that is the objects to be heated, the decrease in the temperature of the food, and/or the like, the steam generated in the heating chamber 2 can be discharged by the supply of such an amount of air as to prevent the drying, temperature decrease and the like in food being heated by the microwaves.

The heating cooker in accordance with the embodiment further includes the blower duct 22 that guides the cooling air flow from the cooling fan 21 into the cooling channel 24 in the magnetron 23.

According to the embodiment, the cooling air flow from the cooling fan 21 is guided by the blower duct 22 into the cooling channel 24 in the magnetron 23, so that the principal component of the cooling air flow from the cooling fan 21 can be supplied into the cooling channel 24 in the magnetron 23, and thus the cooling efficiency for the magnetron 23 is further improved.

The heating cooker in accordance with the embodiment includes the body casing 1, the heating chamber 2 that is placed in the body casing 1, the magnetron 23 that is placed in the body casing 1 and that supplies the microwaves into the heating chamber 2, the cooling fan 21 that is placed in the body casing 1 and that delivers the cooling air flow into the magnetron 23, the first guiding channel 25 that guides into the heating chamber 2 the portion of the cooling air flow which has flowed out to the downstream side after cooling the magnetron 23, the second guiding channel 26 that guides to an air discharge side another portion of the cooling air flow which has flowed out to the downstream side after cooling the magnetron 23, and the air discharge duct 50 that causes the discharge air discharged from the inside of the heating chamber 2 and the cooling air flow guided by the second guiding channel 26 to be mixed therein and to be discharged to the outside.

According to an above configuration, the portion of the cooling air flow from the cooling fan 21 placed in the body casing 1 that has flowed out to the downstream side after cooling the magnetron 23 is guided into the heating chamber 2 by the first guiding channel 25 and another portion of the cooling air flow from the cooling fan 21 that has flowed out to the downstream side after cooling the magnetron 23 is guided toward the air discharge duct 50 by the second guiding channel 26. The discharge air from the inside of the heating chamber 2 and the cooling air flow guided by the second guiding channel 26 are mixed in the air discharge duct 50 and are then discharged. The cooling air flow guided through the first guiding channel 25 into the heating chamber 2 flows, as the discharge air from the inside of the heating chamber 2, toward the air discharge duct 50. That is, the cooling air flow divided into the two portions by the first and second guiding channel 25 and 26 after passing through the magnetron 23 from the cooling fan 21 joins again in the air discharge duct 50 and is then discharged. The cooling air flow guided by the second guiding channel 26 after cooling the magnetron 23 has the low humidity and the temperature of the cooling air flow is decreased by the passage of the cooling air flow through the second guiding channel 26. Thus the discharge air from the inside of the heating chamber 2 can be discharged while the temperature and humidity of the discharge air are efficiently decreased. In addition, the supply of the air into the heating chamber 2 and the cooling of the magnetron 23 can be carried out by the one cooling fan 21.

The heating cooker in accordance with the embodiment further includes the drag part provided in the air discharge port 9 on the downstream side in the air discharge duct 50.

According to the embodiment, the flow velocity in the air discharge duct 50 is decreased by the drag part provided in the air discharge port 9 on the downstream side in the air discharge duct 50 and thus the mixing and dilution of the discharge air from the inside of the heating chamber 2 and the cooling air flow guided by the second guiding channel 26 are promoted before the discharge through the air discharge port 9.

The heating cooker in accordance with the embodiment further includes the air intake ports 10 provided on the front face of the body casing 1 and the air discharge port 9 on the downstream side in the air discharge duct 50 is provided on the front face of the body casing 1 so that the discharge air mixed in the air discharge duct 50 blows off toward the side opposed to the air intake ports 10.

According to the embodiment, the air discharge port 9 on the downstream side in the air discharge duct 50 is provided on the front face side of the body casing 1 so that the discharge air mixed in the air discharge duct 50 blows off toward the side opposed to the air intake ports 10 provided on the front face side of the body casing 1 and thus the discharge air discharged from the air discharge port 9 of the air discharge duct 50 can be inhibited from being sucked again into the air intake ports 10. By such prevention of the resuction, the decrease in the cooling efficiency for the electric components in the body casing 1 can be prevented.

The heating cooker in accordance with the embodiment further includes the air discharge fans 31 and 32 provided on the rear face side of the air discharge duct 50, and the inclined members 51 and 52 provided at the positions where the cooling air flow from the first guiding channel 25 or the second guiding channel 26 flows into the air discharge duct 50, and the inclined members 51 and 52 extend to the positions facing the front face sides of the air discharge fans 31 and 32.

According to the embodiment, the extension of the inclined members 51 and 52 to the positions facing the air discharge fans 31 and 32 results in change in the direction of the cooling air flow that blows from the air discharge fans 31 and 32 and thereby causes the turbulent flow. Consequently, the cooling air flow flowing into the air discharge duct 50 under the guidance of the second guiding channel 26 and the discharge air from the inside of the heating chamber 2 can efficiently be mixed.

The heating cooker in accordance with the embodiment further includes the guiding part that guides the dew condensation water, accumulated in the bottom part of the air discharge duct 50, into the second guiding channel 26.

According to the embodiment, when the steam included in the discharge air from the inside of the heating chamber 2 condenses in the air discharge duct 50, the dew condensation water accumulated in the bottom part of the air discharge duct 50 is guided into the second guiding channel 26 by the guiding part and can be evaporated in the second guiding channel 26 by the dry cooling air flow having the temperature increased by the cooling of the magnetron 23.

The heating cooker in accordance with the embodiment further includes the air heat-insulating layer 51 in a part that provides partition between the air discharge duct 50 and the heating chamber 2.

According to the embodiment, the air heat-insulating layer 51 is provided in the part that provides the partition between the air discharge duct 50 and the heating chamber 2 and thus the condensation of the discharge air having the high temperature and the high humidity on the upper surface of the air heat-insulating layer 51 can be prevented when the lower side of the air heat-insulating layer 51 is cooled by the cooling air flow supplied by the air discharge fan 31.

The heating cooker in accordance with the embodiment further includes the ejector part 90 that is provided in the air discharge duct 50 and that is for drawing the discharge air from the inside of the heating chamber 2 into the air discharge duct 50 by the cooling air flow flowing into the air discharge duct 50 under the guidance of the second guiding channel 26.

According to the embodiment, through agency of the ejector part 90 provided in the air discharge duct 50, the discharge air from the inside of the heating chamber 2 can be drawn into the air discharge duct 50 by the cooling air flow flowing into the air discharge duct 50 under the guidance of the second guiding channel 26. The discharge air from the inside of the heating chamber 2 is drawn into the air discharge duct 50 without the employment of the air discharge fans in the air discharge duct 50 through agency of the ejector part 90 by the cooling air flow flowing into the air discharge duct 50 under the guidance of the second guiding channel 26 and thus the mixing of the discharge air from the inside of the heating chamber 2 and the cooling air flow guided by the second guiding channel 26 and simplification of configuration can be attained.

In the heating cooker in accordance with the embodiment, the cooling air flow from the second guiding channel 26 that flows into the air discharge duct 50 is higher in flow velocity than the discharge air from the inside of the heating chamber 2 that flows into the air discharge duct 50.

According to the embodiment, the cooling air flow from the second guiding channel 26 that flows into the air discharge duct 50 is higher in flow velocity than the discharge air from the inside of the heating chamber 2 that flows into the air discharge duct 50 and thus the ejector effect can be increased that causes the discharge air from the inside of the heating chamber 2 to be drawn into the air discharge duct 50 by the ejector part 90.

The heating cooker in accordance with the embodiment further includes the third guiding channel that guides the portion of the cooling air flow from the cooling fan 21 so that the portion blows off toward the electric components in the body casing 1 without passing through the cooling channel 24 in the magnetron 23, and in an air discharge path for the discharge from the air discharge duct 50 to the outside, the cooling air flow guided by the third guiding channel is made to flow into the air discharge duct 50 on the upstream side of the position where the cooling air flow from the second guiding channel 26 flows into the air discharge duct 50.

According to the embodiment, the cooling of the magnetron 23 and the cooling of other electric components can be carried out by the one cooling fan 21 and the discharge air from the heating chamber 2 can be diluted with the cooling air flow for the both, so that number of the fans can be decreased.

REFERENCE SIGNS LIST

1 body casing
1*a* upper cover
2 heating chamber
3 door
4 handle
5 heat resistant glass plate
6 operation panel
7 liquid crystal display part
8 power switch
9 air discharge port
10 air intake port
21 cooling fan
22 blower duct
23 magnetron
23*a* cooling fin
24 cooling channel
25 first guiding channel
26 second guiding channel
26*a* front face wall part
27 connection duct
28 linear part
29 bent part
30 power supply part
31, 32 air discharge fan
40 display substrate
41 partition plate
42 frame member
50 air discharge duct
60 mounting plate
70 blow-off grill
80 partition plate
81 path
90 ejector part

The invention claimed is:

1. A heating cooker comprising:

a body casing, a heating chamber that is placed in the body casing, a magnetron that is placed in the body casing and that supplies microwaves into the heating chamber, a cooling fan that is placed in the body casing and that delivers cooling air flow to the magnetron, an air discharge duct that is for discharging discharge air from inside of the heating chamber to outside, wherein the air discharge duct causes the discharge air discharged from the heating chamber and the cooling air flow guided by the second guiding channel to be mixed therein and to be discharged to the outside, a first guiding channel that guides into the heating chamber a portion of the cooling air flow from the cooling fan which has flowed out to a downstream side after cooling the magnetron, and a second guiding channel that guides toward the air discharge duct another portion of the cooling air flow from the cooling fan which has flowed out to the downstream side after cooling the magnetron.

2. The heating cooker as claimed in claim 1, further comprising a third guiding channel that guides a portion of the cooling air flow from the cooling fan so that the portion blows off toward a front face side in the body casing without passing through a cooling channel in the magnetron.

3. The heating cooker as claimed in claim 2, further comprising air intake ports provided on the front face side of the body casing, wherein the cooling fan sucks outside air from the front face side through the air intake ports.

4. The heating cooker as claimed in claim 2, wherein, in an air discharge path for discharge from the air discharge duct to the outside, the cooling air flow guided by the third guiding channel is made to flow into the air discharge duct on an upstream side of a position where the cooling air flow from the second guiding channel flows into the air discharge duct.

5. The heating cooker as claimed in claim 1, comprising air intake ports provided on a front face side of the body casing, wherein an air discharge port on a downstream side in the air discharge duct is provided on the front face of the body casing so that the discharge air mixed in the air discharge duct blows off toward a side opposed to the air intake ports.

6. The heating cooker as claimed in claim 1, further comprising an ejector part that is provided in the air discharge duct and that is for drawing the discharge air from the inside of the heating chamber into the air discharge duct by the cooling air flow flowing into the air discharge duct under guidance of the second guiding channel.

7. The heating cooker as claimed in claim 1, further comprising a blower duct that guides the cooling air flow from the cooling fan into a cooling channel in the magnetron.

8. The heating cooker as claimed in claim 1, further comprising air discharge fans provided on a rear face side of the air discharge duct, and inclined members provided at positions where the cooling air flow from the first guiding channel or the second guiding channel flows into the air discharge duct, wherein the inclined members extend to positions facing front face sides of the air discharge fans.

9. The heating cooker as claimed in claim 1, further comprising a guiding part that guides dew condensation water, accumulated in a bottom part of the air discharge duct, into the second guiding channel.

10. The heating cooker as claimed in claim 2, wherein an air curtain is formed on a front face side in the body casing 1 by a portion of the cooling air flow guided by the third guiding channel form the cooling fan.

* * * * *